US006783436B1

(12) United States Patent
Muldowney

(10) Patent No.: US 6,783,436 B1
(45) Date of Patent: Aug. 31, 2004

(54) POLISHING PAD WITH OPTIMIZED GROOVES AND METHOD OF FORMING SAME

(75) Inventor: Gregory P. Muldowney, Glen Mills, PA (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/425,689

(22) Filed: Apr. 29, 2003

(51) Int. Cl.[7] ..... B24B 1/00; B24D 11/00
(52) U.S. Cl. ..... 451/41; 451/527; 451/550
(58) Field of Search ..... 451/527, 528, 451/529, 530, 533, 550, 539, 41, 60, 63

(56) References Cited

U.S. PATENT DOCUMENTS

| | | | | |
|---|---|---|---|---|
| 4,663,890 A | * | 5/1987 | Brandt | 451/41 |
| 5,020,283 A | | 6/1991 | Tuttle | |
| 5,131,190 A | * | 7/1992 | Gougouyan | 451/286 |
| 5,177,908 A | | 1/1993 | Tuttle | |
| 5,297,364 A | | 3/1994 | Tuttle | |
| 5,329,734 A | | 7/1994 | Yu | |
| 5,645,469 A | | 7/1997 | Burke et al. | |
| 5,650,039 A | | 7/1997 | Talieh | |
| 5,690,540 A | | 11/1997 | Elliott et al. | |
| 5,888,121 A | | 3/1999 | Kirchner et al. | |
| 5,921,855 A | | 7/1999 | Osterheld et al. | |
| 5,984,769 A | | 11/1999 | Bennett et al. | |
| 6,120,366 A | | 9/2000 | Lin et al. | |
| 6,159,088 A | | 12/2000 | Nakajima | |
| 6,254,456 B1 | | 7/2001 | Kirchner et al. | |
| 6,273,806 B1 | | 8/2001 | Bennett et al. | |
| 6,340,325 B1 | | 1/2002 | Chen et al. | |
| 6,390,891 B1 | | 5/2002 | Guha et al. | |
| 2002/0068516 A1 | | 6/2002 | Chen et al. | |
| 2002/0137450 A1 | | 9/2002 | Osterheld et al. | |

FOREIGN PATENT DOCUMENTS

| | | |
|---|---|---|
| FR | 2 063 961 | 7/1971 |
| JP | 61-182753 A | 8/1986 |
| JP | 2002-144219 A | 5/2002 |
| WO | WO 98/12020 A1 | 3/1998 |
| WO | WO 02/02279 A2 | 1/2002 |

OTHER PUBLICATIONS

Hansen, David A.; Barr, Mike; King, Jan; Kerba, Emile; Mogi, Katsumi; "Characterizatioin of a Multiple–Head Chemical Mechanical Polisher for Manufacturing Applications"; 1996 CMP–MIC Conference: Feb. 22–23, 1996. pp. 209–215.

* cited by examiner

*Primary Examiner*—Hadi Shakeri
(74) *Attorney, Agent, or Firm*—Edwin Oh; Blake T. Biederman

(57) ABSTRACT

A polishing pad useful for chemical mechanical planarization has a polishing layer for planarizing substrates. The polishing layer comprises a radius that extends from a center of the polishing layer to an outer perimeter of the polishing layer; one or more continuous grooves formed in the polishing layer and extending inward from the outer perimeter of the polishing layer; and a circumference fraction grooved (CF). The CF occurs in the area extending from the outer perimeter of the polishing layer a majority distance to the center of the polishing layer; and CF is that portion of circumference at a given radius lying across the one or more continuous grooves divided by full circumference at the given radius. The CF remains within 25% of its average value as a function of the polishing layer radius.

10 Claims, 17 Drawing Sheets

POLISHING PAD WITH OPTIMIZED GROOVES AND METHOD OF FORMING SAME

BACKGROUND OF THE INVENTION

The present invention relates to polishing pads for chemical mechanical polishing (CMP), and in particular relates to a polishing pad having optimized grooves.

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates such as semiconductor wafers. In conventional CMP, a wafer carrier or polishing head is mounted on a carrier assembly and positioned in contact with a polishing pad in a CMP apparatus. The carrier assembly provides a controllable pressure to the wafer, urging it against the polishing pad. The pad is moved (e.g., rotated) relative to the wafer by an external driving force. Simultaneously therewith, a chemical composition ("slurry") or other fluid medium is flowed onto the polishing pad and into the gap between the wafer and the polishing pad. The wafer surface is thus polished and made planar by the chemical and mechanical action of the polishing layer and slurry.

In CMP, planarity and uniformity of the wafer surface are paramount. Accordingly, CMP systems are typically configured to provide orbital and/or oscillatory motion of the wafer to average out variations in instantaneous local polish rate. It is known that pad and wafer rotation speeds can be combined in a way that, over time, results in each point of the wafer surface being exposed to the same range and mean value of relative pad velocity. Such an arrangement is described in the article by D. A. Hansen et al, entitled "Characterization of a Multiple-Head Chemical Mechanical Polisher for Manufacturing Applications", Proceedings of the 1 st International CMP-MIC, February 1996, which article is incorporated herein by reference.

The averaging mathematics for the wafer and pad rotations presume that the polishing layer is homogeneous with respect to radial position. However, where the polishing layer includes certain types of grooves (e.g., concentric circles, Cartesian grids, fixed-width radii, or combinations of these), the polishing surface area per unit pad area can vary as a function of pad radius.

FIG. 1A is plot of a standard prior art radial groove pattern, such as described in U.S. Pat. No. 5,177,908. FIG. 1B is a plot of the circumference fraction grooved CF as a function of pad radius R for the radial groove pattern of FIG. 1A. For purposes of this application, the circumference fraction grooved CF is as follows:

(Portion of circumference at a given radius that lies across any groove)/CF=(Full circumference at the given radius)

Note: If CF is constant as a function of radius, then the fractional area of the pad that is grooved (or ungrooved) at a given radius is also constant as a function of radius.

With continuing reference to FIG. 1A, since the number and width of the grooves is fixed, the total grooved length along a circumference is the same regardless of radius. Thus, as shown in FIG. 1B, CF decreases as the distance from the center increases, with the value of CF near the outer edge of the pad being many times smaller than that near the center.

FIG. 2A is a plot of a standard prior art concentric circular groove pattern. FIG. 2B is a plot of the circumference fraction grooved CF as a function of pad radius R for the concentric circular groove pattern of FIG. 2A. In this case, CF is unity at any radius that falls within a groove, and zero at any radius that does not. The area fraction grooved is thus a sharply changing function of radius.

FIG. 3A is a plot of a standard prior art Cartesian grid groove pattern with equal pitch in both coordinate directions. FIG. 3B is a plot of CF as a function of pad radius R for the Cartesian grid groove pattern of FIG. 3A. Note that CF decreases with increasing radius until a new set of grid lines is crossed, at which point the fraction sharply increases. At larger values of radius, even small increments in radial distance cross additional grid lines, so that CF is a highly irregular function. At large radius values where CF begins to asymptote, there is significant (i.e., over 50%) variation in the polishing area per unit pad area.

FIG. 4A is a plot of a standard prior art spiral groove pattern, such as disclosed in U.S. Pat. Nos. 5,921,855 and 5,690,540 (the '540 Patent). FIG. 4B is a plot of CF as a function of pad radius R for the spiral groove pattern of FIG. 4A. Note that CF decreases with increasing radius because the spiral curve does not grow in exact proportion to the radius.

Accordingly, there is a need for a polishing pad with grooves that properly account for the mutual rotations of the wafer and polishing pad.

Statement of the Invention

An aspect of the invention is a polishing pad useful for chemical mechanical planarization, the polishing pad having a polishing layer for planarizing substrates, the polishing layer comprising: a radius that extends from a center of the polishing layer to an outer perimeter of the polishing layer; one or more continuous grooves formed in the polishing layer and extending inward from the outer perimeter of the polishing layer; and a circumference fraction grooved (CF) in an area extending from the outer perimeter of the polishing layer a majority distance to the center of the polishing layer, CF being that portion of circumference at a given radius lying across the one or more continuous grooves divided by full circumference at the given radius, and wherein CF remains within 25% of its average value as a function of the polishing layer radius in the area extending from the outer perimeter of the polishing layer the majority distance to the center of the polishing layer.

In another aspect of the invention, the one or more continuous grooves start at a base radius and extend to an outer perimeter of the pad. Alternatively, the one or more continuous grooves start at a starting radius between the base radius and the outer perimeter, and extend to the outer perimeter.

Another aspect of the invention is a method of planarizing a wafer surface. The method of chemical mechanical planarizing a substrate comprises the steps of: introducing a polishing solution to a wafer; rotating the wafer with respect to a polishing pad, the polishing pad having a polishing layer, and the polishing layer comprising: i) a radius that extends from a center of the polishing layer to an outer perimeter of the polishing layer; ii) one or more continuous grooves formed in the polishing layer and extending inward from the outer perimeter of the polishing layer; and iii) a circumference fraction grooved (CF) in an area extending from the outer perimeter of the polishing layer a majority distance to the center of the polishing layer, CF being that portion of circumference at a given radius lying across the one or more continuous grooves divided by full circumference at the given radius, and wherein CF remains within 25% of its average value as a function of the polishing layer radius in the area extending from the outer perimeter of the polishing layer the majority distance to the center of the polishing layer; and planarizing the wafer with the polishing pad and the polishing solution.

DETAILED DESCRIPTION

Figure 1A:
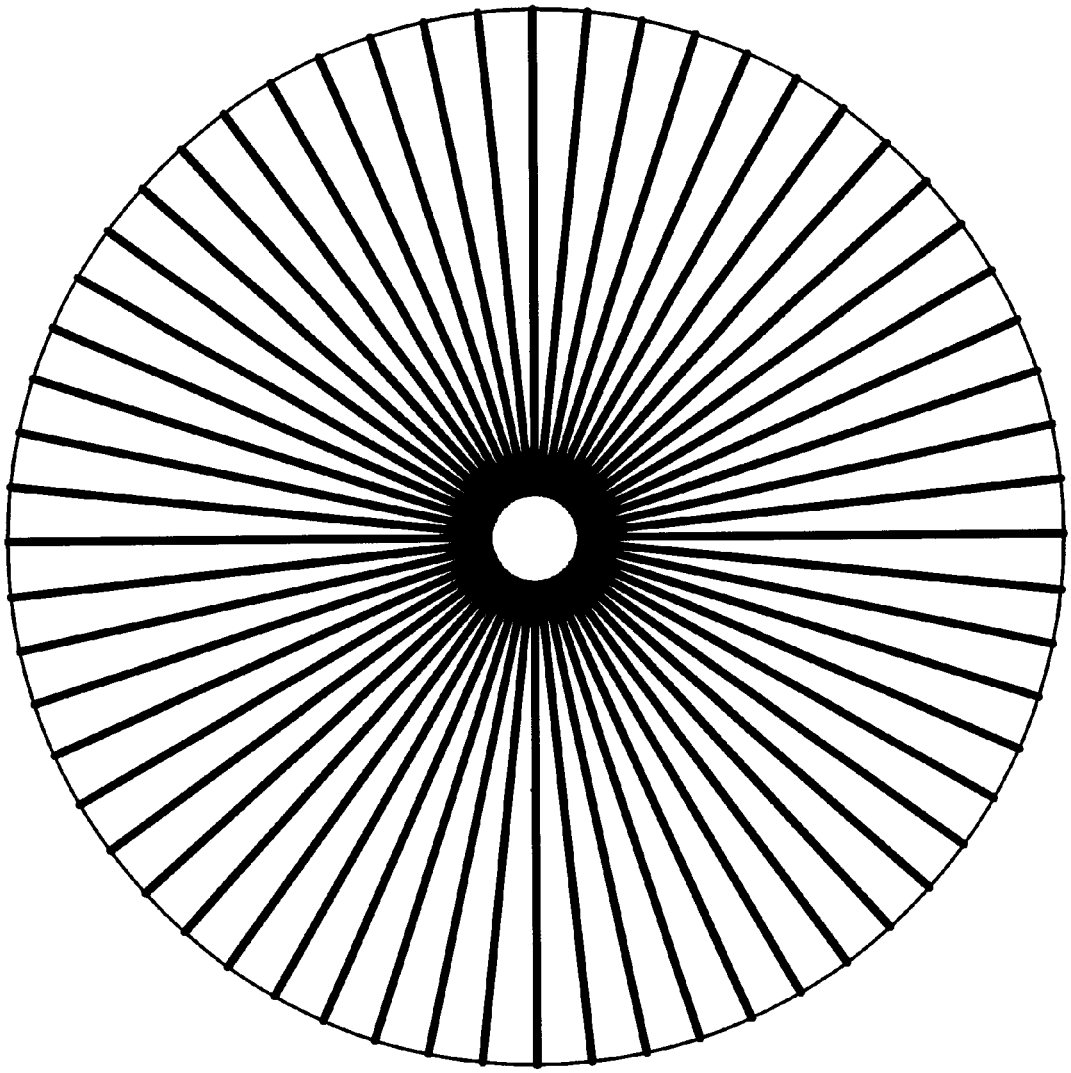
FIG. 1A ( PRIOR ART )
FIG. 1A is plot of an example prior art polishing pad radial groove pattern having 60 grooves on a 24 inch outer pad radius and a 2 inch base radius, with each groove being 0.093 inches wide.
Figure 1B:
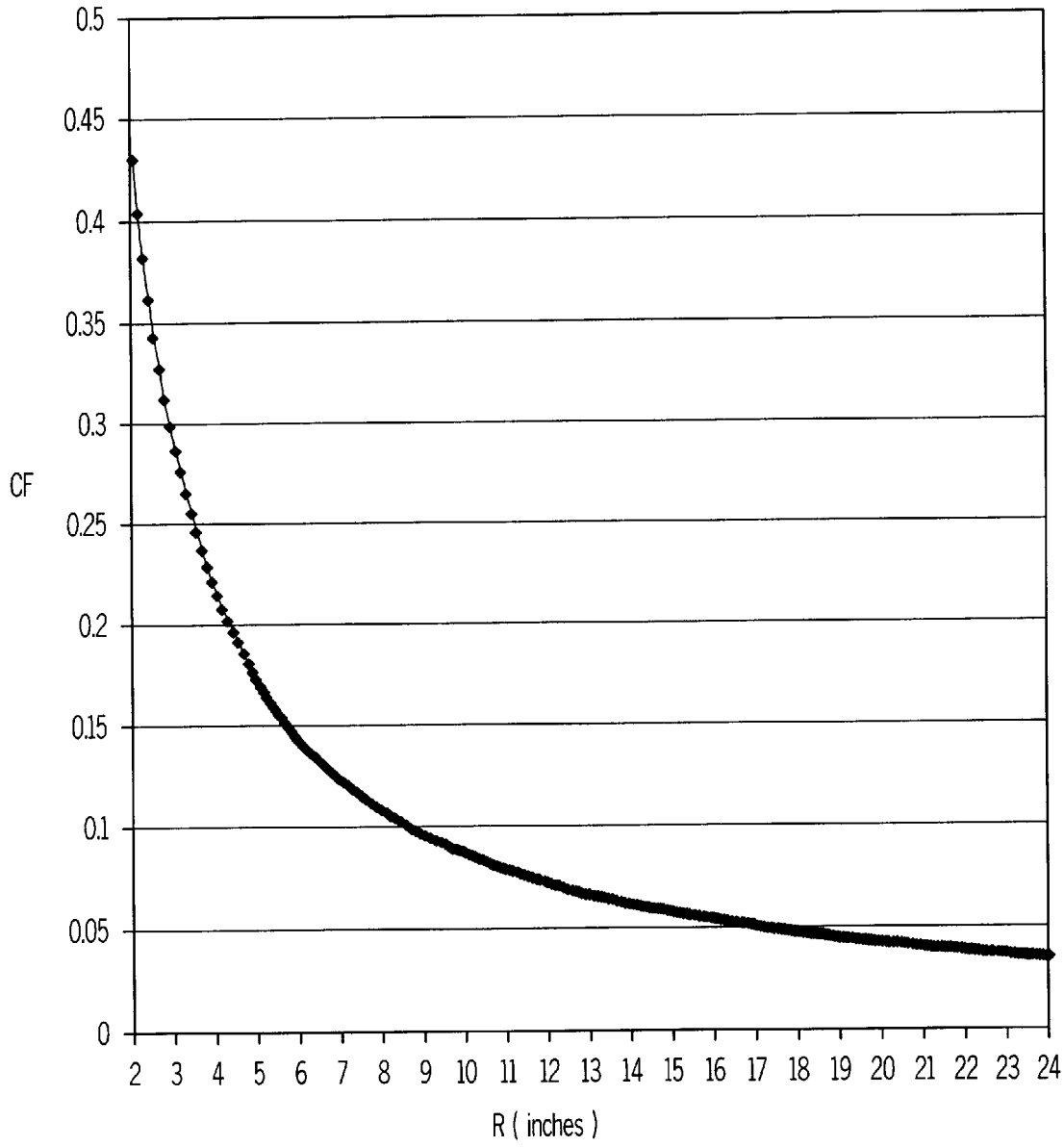
FIG. 1B ( PRIOR ART )
FIG. 1B is a plot of the circumference fraction grooved CF as a function of pad radius R for the radial groove pattern of FIG. 1A.
Figure 2A:
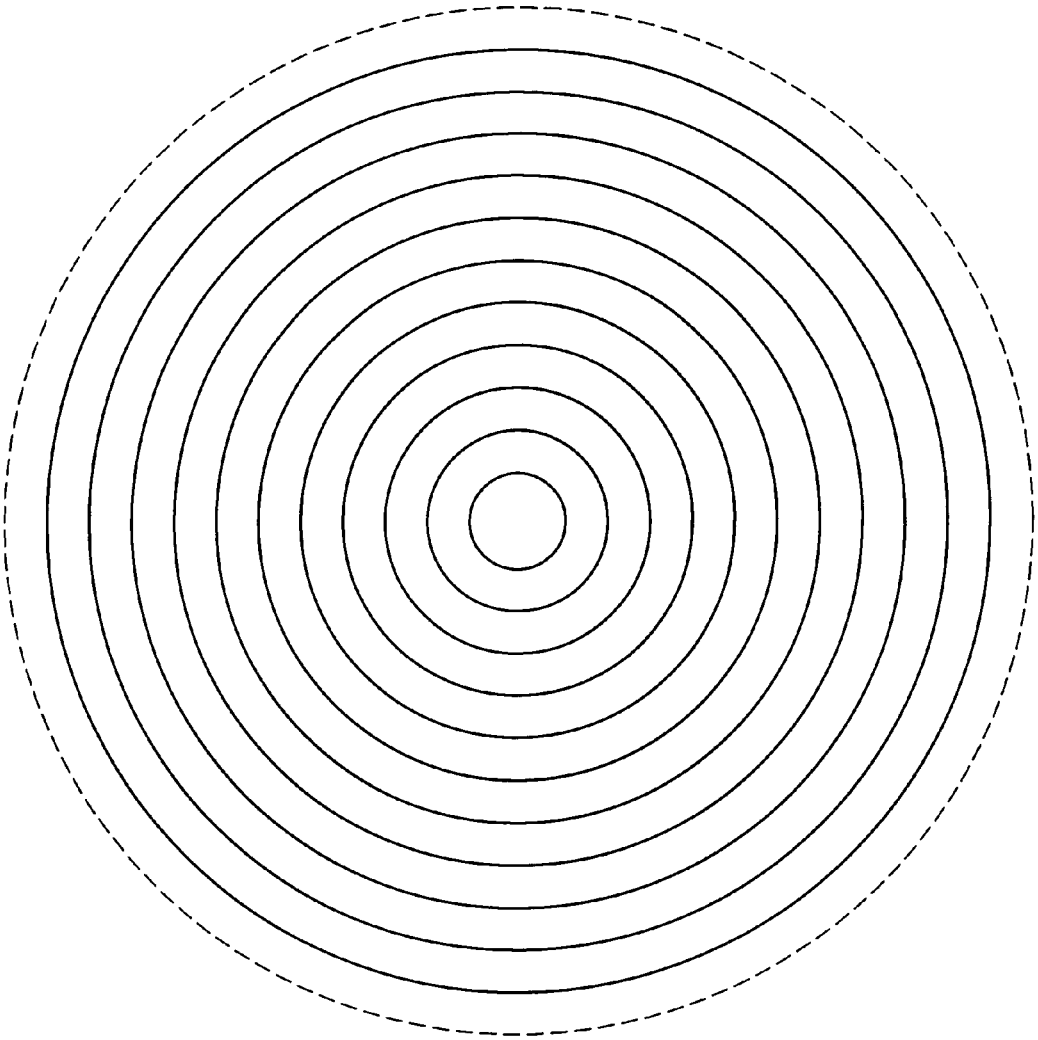
FIG. 2A ( PRIOR ART )
FIG. 2A is a plot of a standard prior art concentric circular groove pattern having 11 grooves on a 24 inch outer pad radius, with each groove being 0.093 inches wide.
Figure 2B:
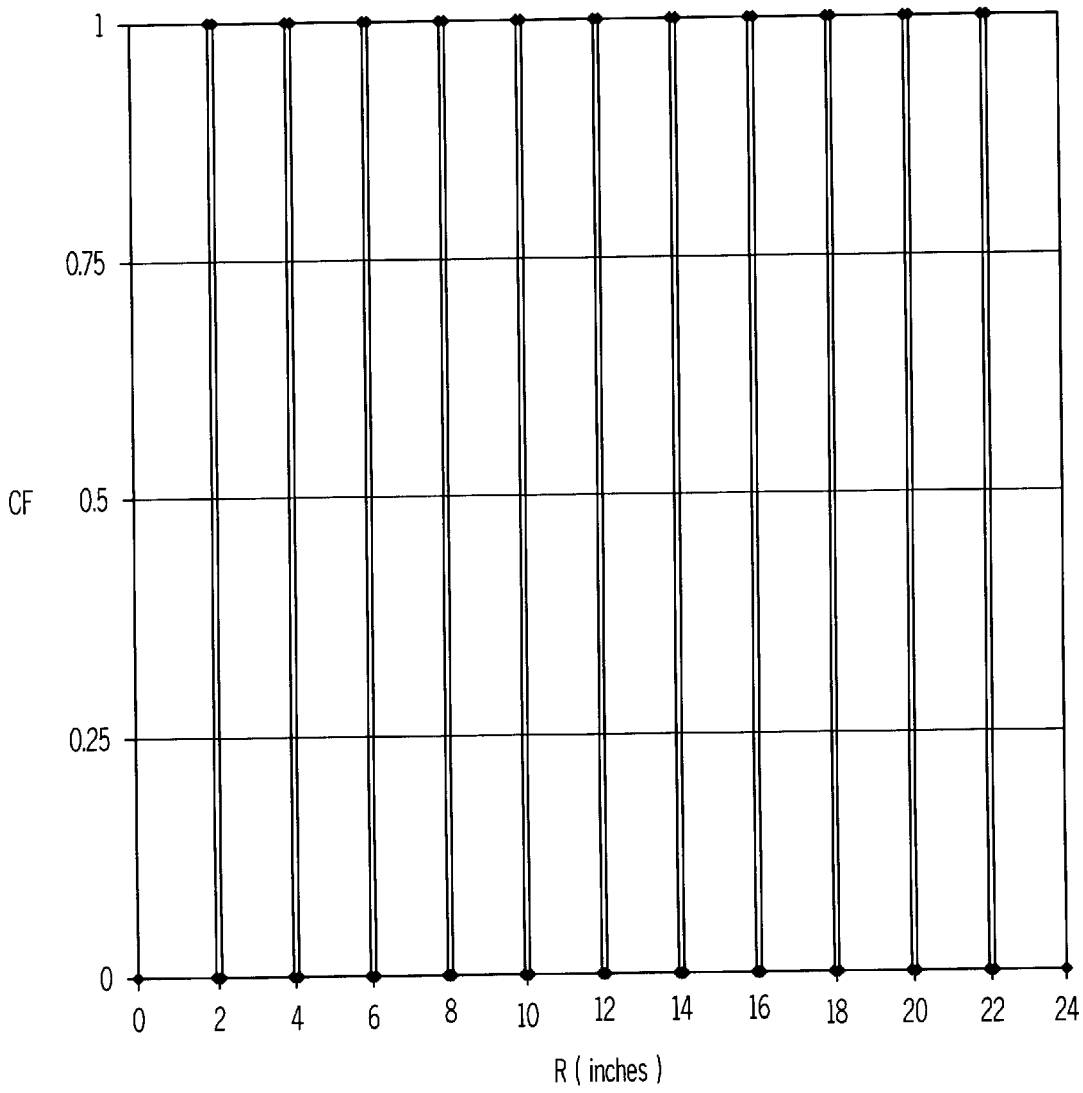
FIG. 2B ( PRIOR ART )
FIG. 2B is a plot of the circumference fraction grooved CF as a function of pad radius R for the concentric circular groove pattern of FIG. 2A.
Figure 3A:
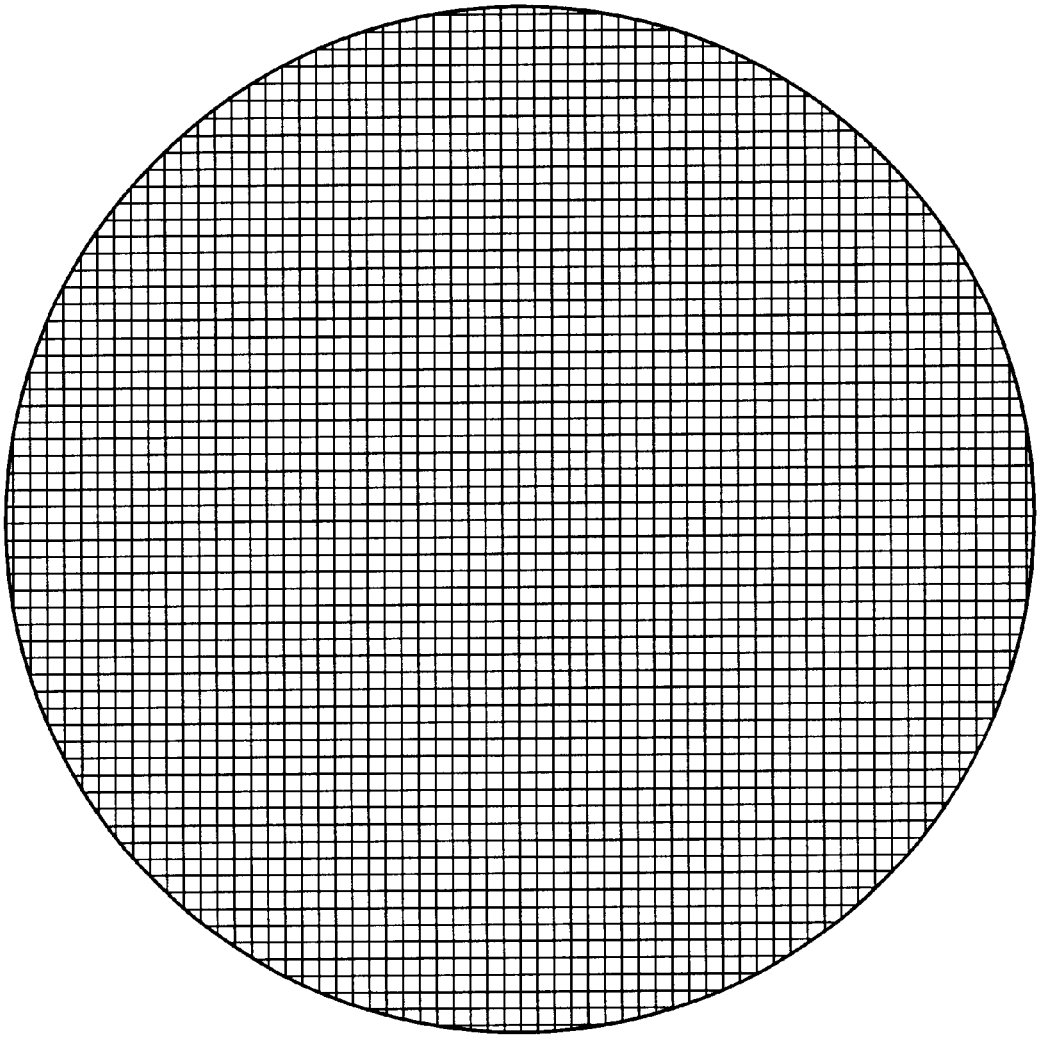
FIG. 3A ( PRIOR ART )
FIG. 3A is a plot of a standard prior art Cartesian grid groove pattern for a 24 inch outer pad radius, with equal-pitch grooves extending in both coordinate directions with a 20 mm groove pitch and a 0.093 inch groove width.
Figure 3B:
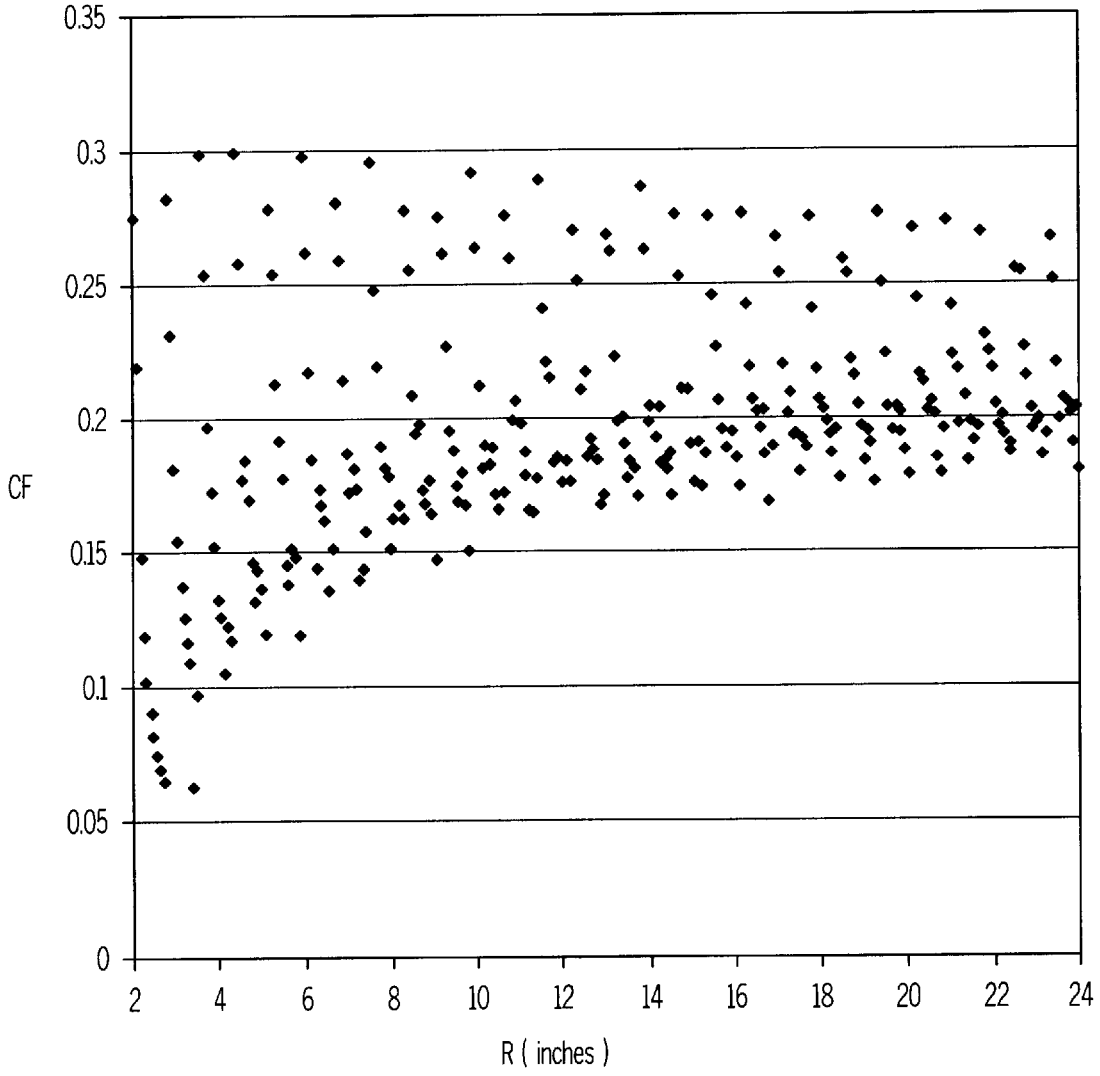
FIG. 3B ( PRIOR ART )
FIG. 3B is a plot of the circumference fraction grooved CF as a function of pad radius R for the Cartesian grid groove pattern of FIG. 3A.
Figure 4A:
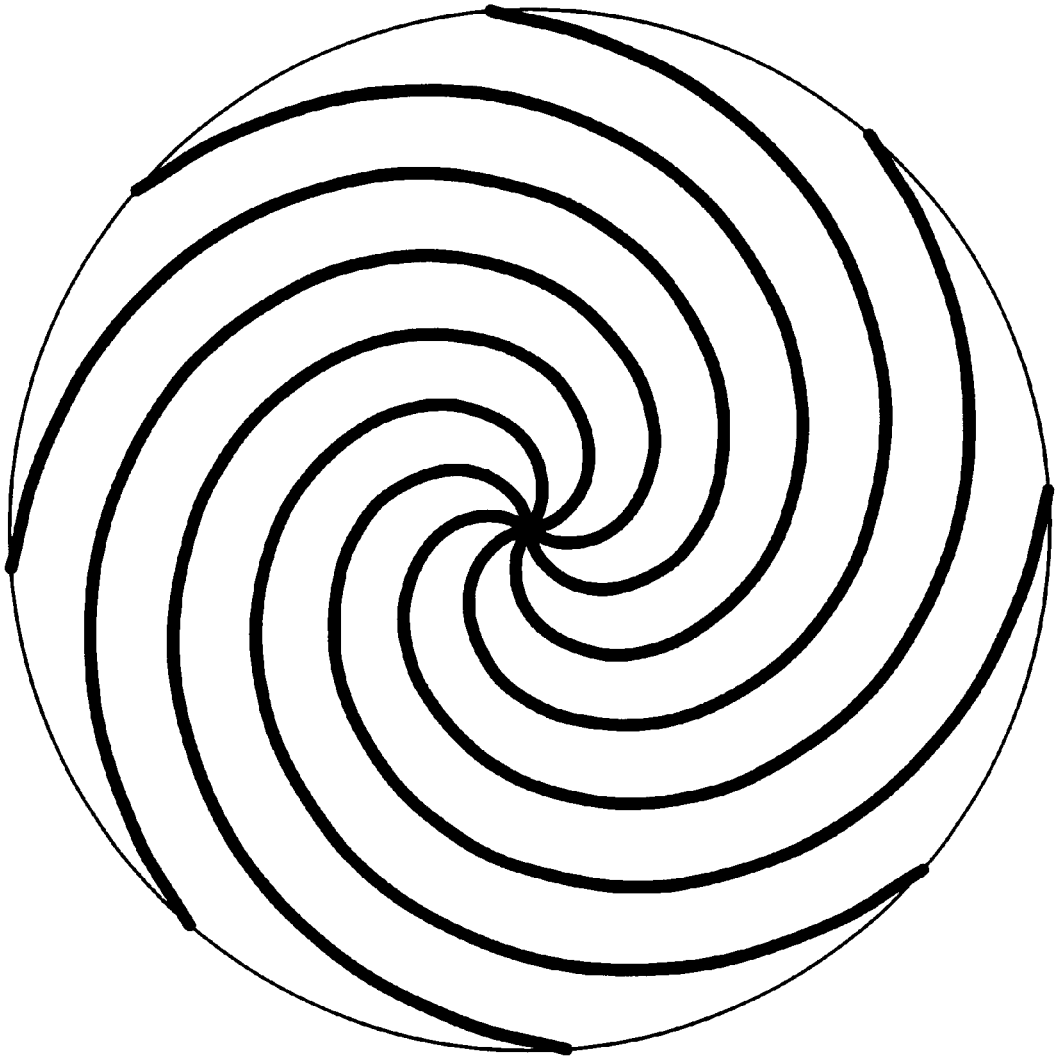
FIG. 4A (PRIOR ART)
FIG. 4A is a plot of a standard prior art spiral groove pattern consistent with that disclosed in the '540 Patent.
Figure 4B:
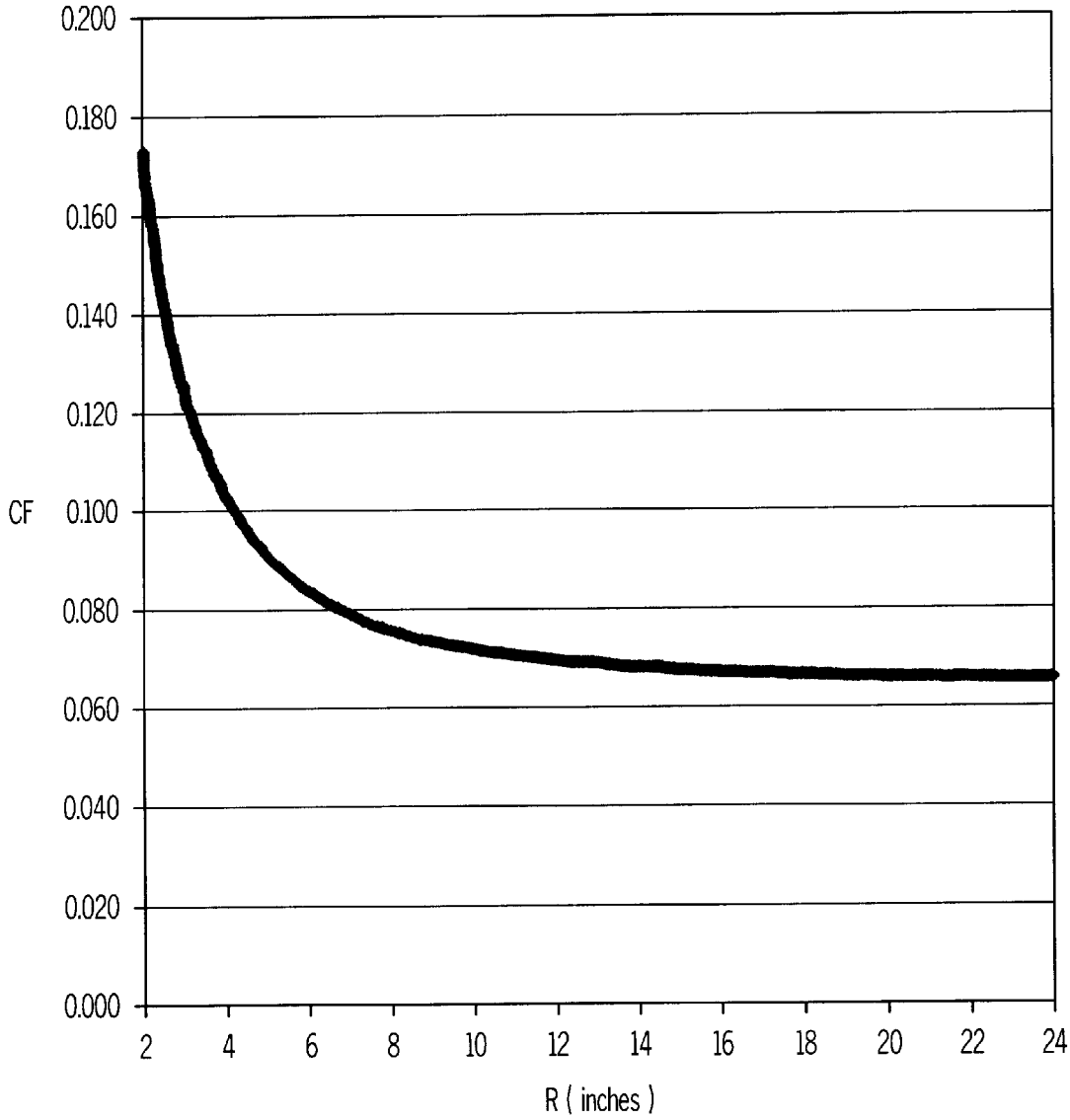
FIG. 4B ( PRIOR ART )
FIG. 4B is a plot of the circumference fraction grooved CF as a function of pad radius R for the spiral groove pattern of FIG. 4A.
Figure 5A:
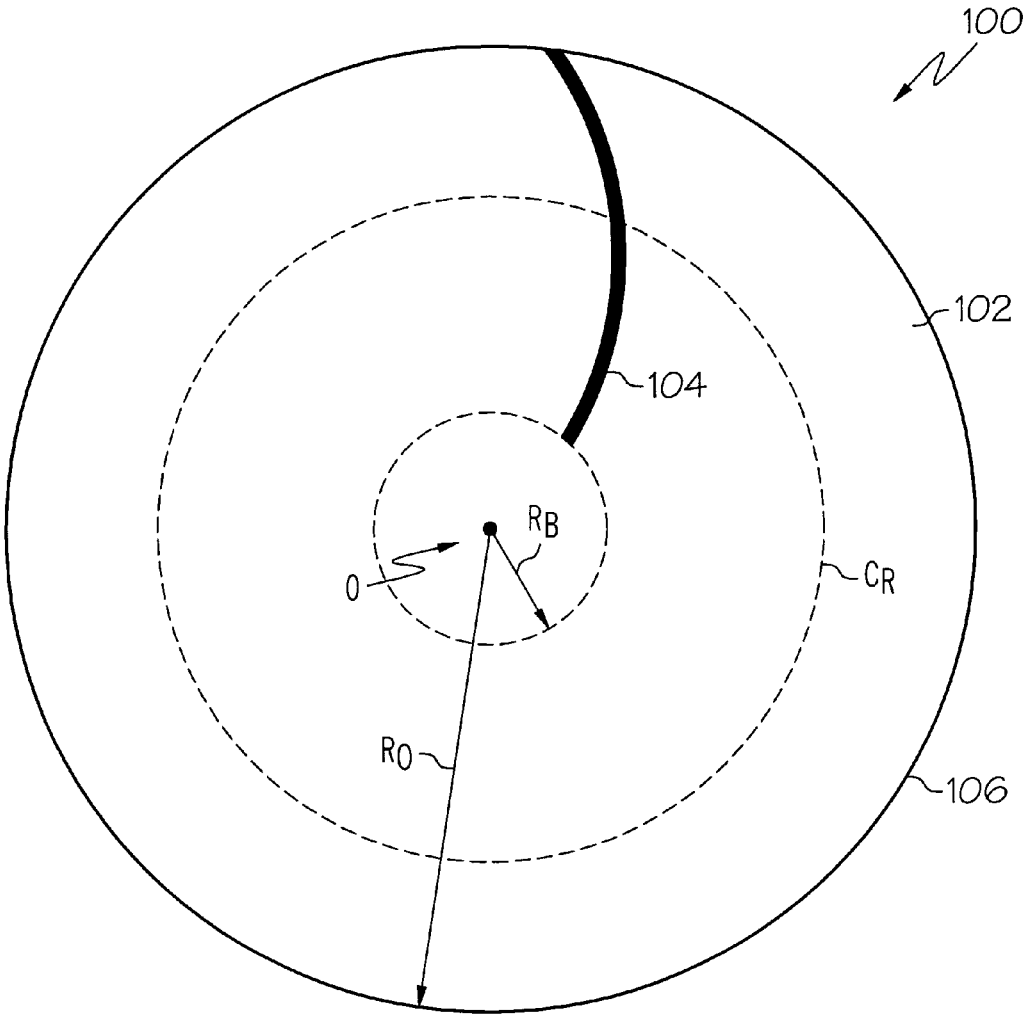
FIG. 5A is plan view of a polishing pad and groove pattern formed therein.

FIG. 5A is a plan view of a polishing pad 100 having an outer radius $R_O$ and a surface 102 with a groove 104 formed therein. In example embodiments, one or more continuous (i.e., unbroken and elongate) grooves 104 are formed in surface 102. The pad radius R is measured from an origin O. A circle $C_R$ (dashed line) with a circumference 2πR is also shown. The outer radius of pad 100 is $R_0$. The one or more grooves 104 extend out to outer radius $R_0$ (i.e., to the edge of the pad). The outer radius $R_O$ of pad 100 defines the outer perimeter 106.

On orbital polishers, there is often a region surrounding the origin O that is not contacted by the wafer. This region typically extends a few inches from the origin O. Accordingly, groove 104 need not necessarily start at the origin O. Alternatively, one or more grooves 104 may start at or near the origin O, but the constraint of CF ratio may be relaxed within the region that does not contact the semiconductor wafer. For example, the polishing pad may contain no grooves, a single grooved region or random grooves near the origin. Although polishing may occur near the origin O, most advantageously the polishing occurs only within the area extending from the outer perimeter of the polishing layer the majority distance to the center or origin O of the polishing layer. This embodiment maintains the wafer within a "wafer track" having the controlled CF.

In example embodiments, a base radius $R_B$ is chosen to obtain a desirable groove curvature without compromising uniform polishing. In example embodiments where the workpiece tends to polish slower at the edge than near the center, the base radius $R_B$ is chosen somewhat larger than the radius of the uncontacted central region. While this increases the material removal at the edge of the workpiece, it does not guarantee uniform polishing.

Thus, in an example embodiment, one or more grooves 104 start from a base radius $R_B$, as shown. In another example embodiment, one or more grooves 104 start from origin O. In another example embodiment, grooves 104 start from a starting radius $R_S$ that is larger than the base radius $R_B$ (see FIG. 6D, discussed below).

Figure 5B:
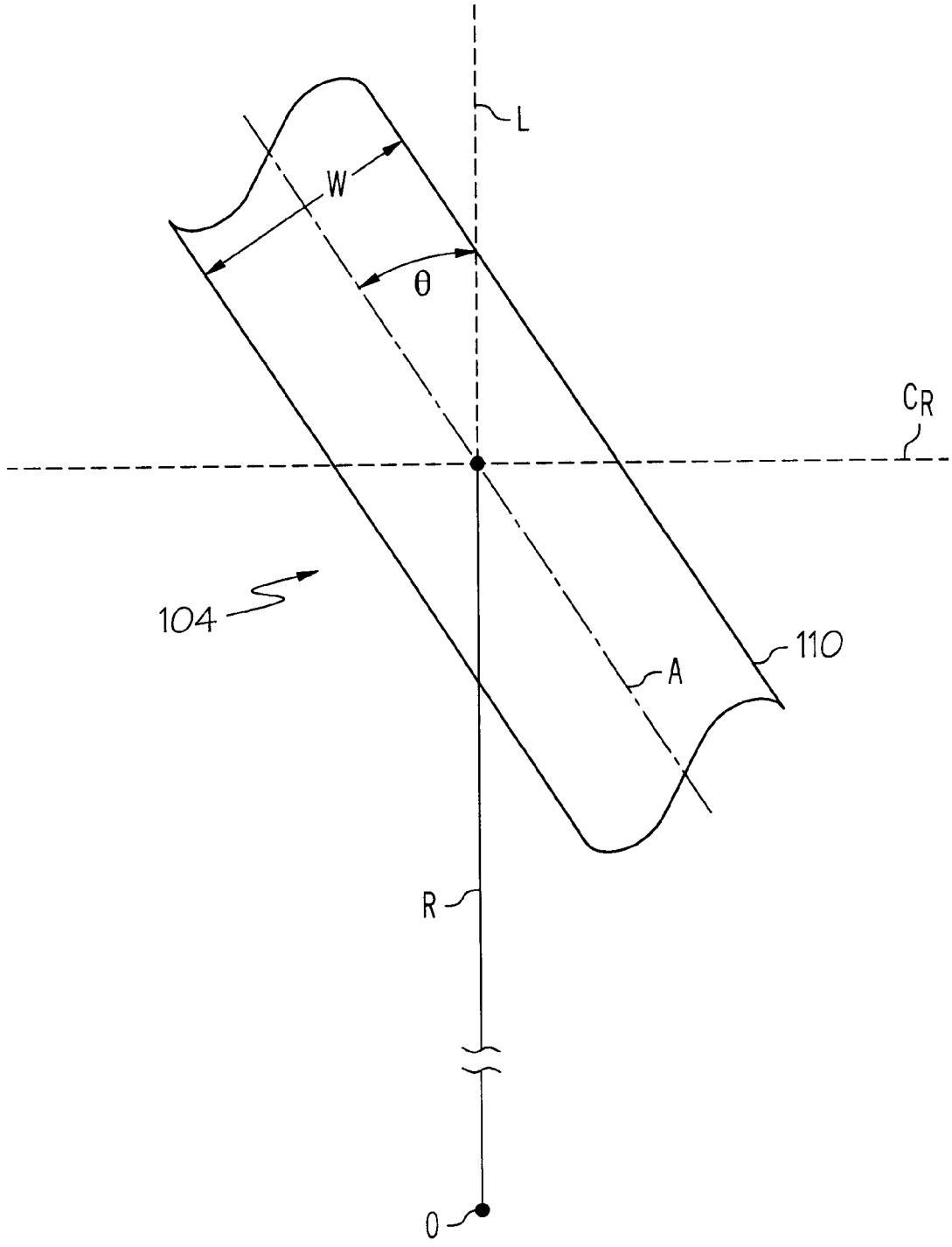
FIG. 5B is a close-up view of a groove segment of the groove of FIG. 5A.

FIG. 5B is a close-up view of polishing layer 102 of FIG. 5A, showing a small differential segment 110 of groove 104. At a given radius R, groove 104 has a given width W and a central axis A that forms an angle θ ("groove angle") with respect to a radial line L connecting the origin O to the given radial position R.

In order for the pad to have the same fractional grooved area at any radius, each circumference $C_R$ needs to traverse an amount of grooved polishing layer that is a fixed fraction of the circumference $C_R$. As discussed above, the ratio of the grooved to total polishing layer at a given circumference $C_R$ is referred to herein as the "circumference fraction grooved," or "CF."

For CF to be constant as a function of radius, each differential groove segment 110 must have an increasingly large groove angle θ as the radius increases so that the groove width taken along a circumference increases to keep up with the increasing length of the circumference. The locus of the segments 110 constitutes a continuous curve corresponding to one groove connecting the base radius $R_B$ to the outer radius $R_0$.

In mathematical terms, if N represents the number of grooves (groove count) N, then:

$$CF=(NW \sec \theta)/(2\pi R) \quad \text{EQ. 1}$$

Note that at the base radius $R_B$, θ=0 so that $$CF=(NW)/(2\pi R). \quad \text{EQ.2}$$

Equating CF at $R_B$ to CF at any radius R requires that the groove angle θ be:

$$\theta(R)=\sec^{-1}(R/R_B). \quad \text{EQ. 3}$$

Figure 5C:
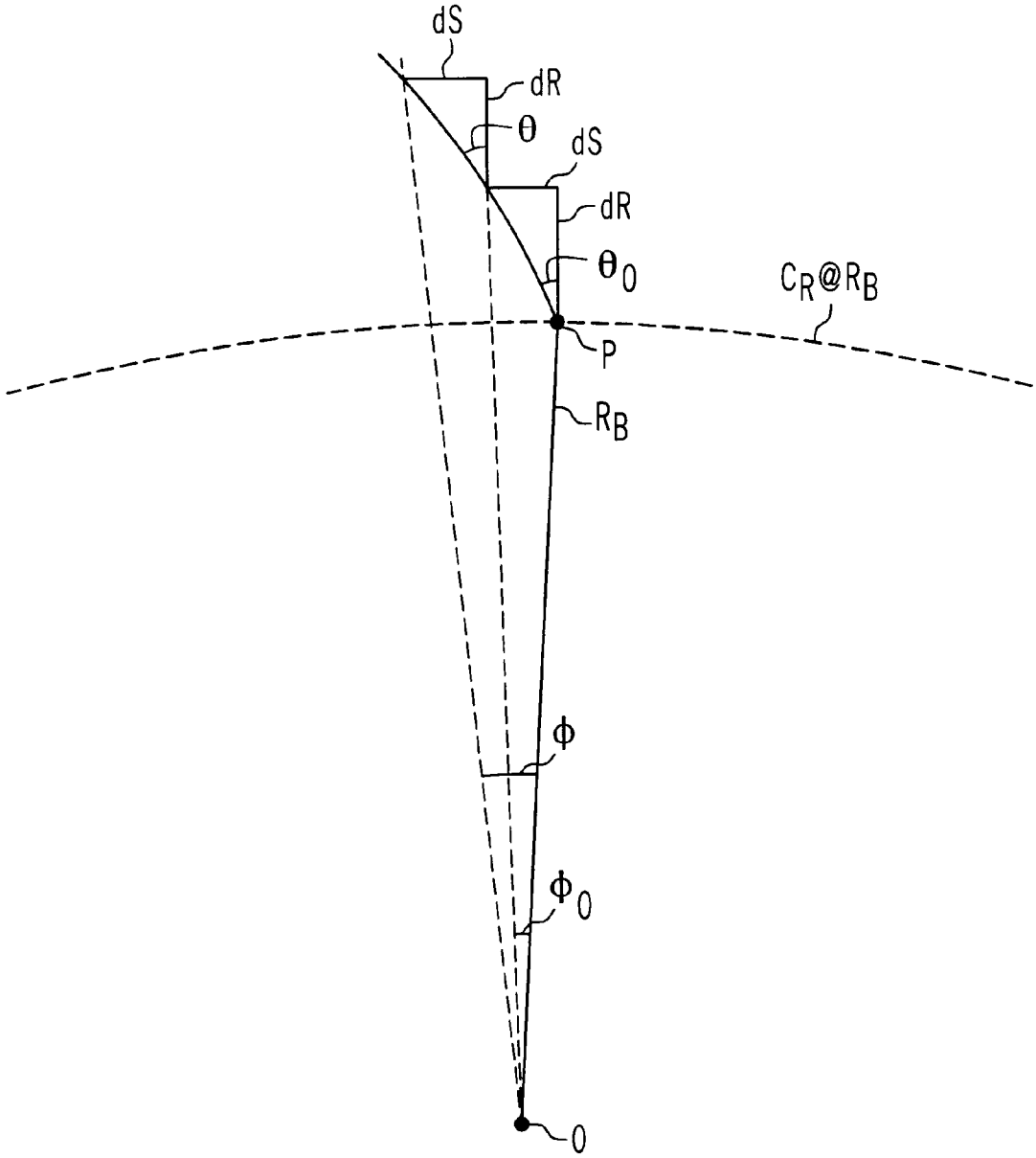
FIG. 5C is a close-up view of a point P at the base radius $R_B$ of the polishing pad of FIG. 5A, illustrating incremental changes in groove angle θ as a function of radius R.

The global equation for, the precise form of the one or more grooves 104 is obtained by taking incremental radial steps directed at the corresponding local groove angle θ(R). This is illustrated in FIG. 5C, which is a close-up view of a point P at the base radius $R_B$ of the polishing pad of 5A. From FIG. 5C, the circumferential segment dS of circumference $C_R$ is related to the radial segment dR as given by:

$$dS=dR \tan \theta. \quad \text{EQ. 4}$$

From equations 3 and 4, it follows that:

$$dS = dR \tan\theta = \sqrt{\left(\frac{R}{Rs}\right)^2 - 1}\, dR \quad \text{EQ. 5}$$

Central angle φ(R) is given by:

$$\varphi(R) = \int_{Rs}^{R} \frac{dS}{R} = \int_{Ra}^{R} \sqrt{\left(\frac{R}{Rw}\right)^2 - 1}\, \frac{dR}{R} \quad \text{EQ. 6}$$

Therefore, $$\varphi(R) = \sqrt{\left(\frac{R}{Rn}\right)^2 - 1} \div \sin^{-1}\left(\frac{Rs}{R}\right) - \frac{\pi}{2} \quad \text{EQ. 7}$$

The one or more grooves 104 are thus formed based on the equations:

$$X=R \cos \phi(R) \text{ and} \quad \text{EQ. 8}$$

$$Y=R \sin \phi(R) \quad \text{EQ. 9}$$

A groove formed consistent with the above analysis results in a constant CF, which translates into constant polishing layer area as a function of radius, which in turn translates into more uniform CMP performance than a polishing pad having grooves with a non-constant CF.

Alternative embodiments of the present invention include forming one or more radial grooves 104 to have widths that increase with radius at a rate that maintains a constant CF. For large diameter pads, however, this embodiment is less advantageous than a continuous curve.

Thus, one example embodiment of the present invention is a polishing pad comprising one or more continuous grooves 104 formed in a manner such that CF is constant (i.e., non-varying) as a function of pad radius. CF can have almost any constant value. However, in a preferred embodiment, the value of CF is in the range from 10% to 25%.

In addition, the present invention applies to forming grooves having a wide range of curvatures. However, in a preferred embodiment, the one or more grooves 104 make anywhere from 1/60th to ½ of a revolution. That is, any individual groove occupies a wedge of the polishing pad forming a central angle of 6 to 180 degrees.

In another example embodiment, the value of CF is non-constant, but remains within 25% of its average value as a function of pad radius, and more preferably remains within 10% of its average value as a function of radius. These limits on CF allow for, among other things, variations from ideal groove formation (e.g., relaxing the groove design tolerance to make the process of groove formation less expensive and less time consuming), and for compensating any polishing effects that are a function of radius (e.g., material removal as a function of slurry distribution).

Grooves 104 formed according to the present invention may be oriented in either direction relative to the pad rotation direction.

Figure 6A:
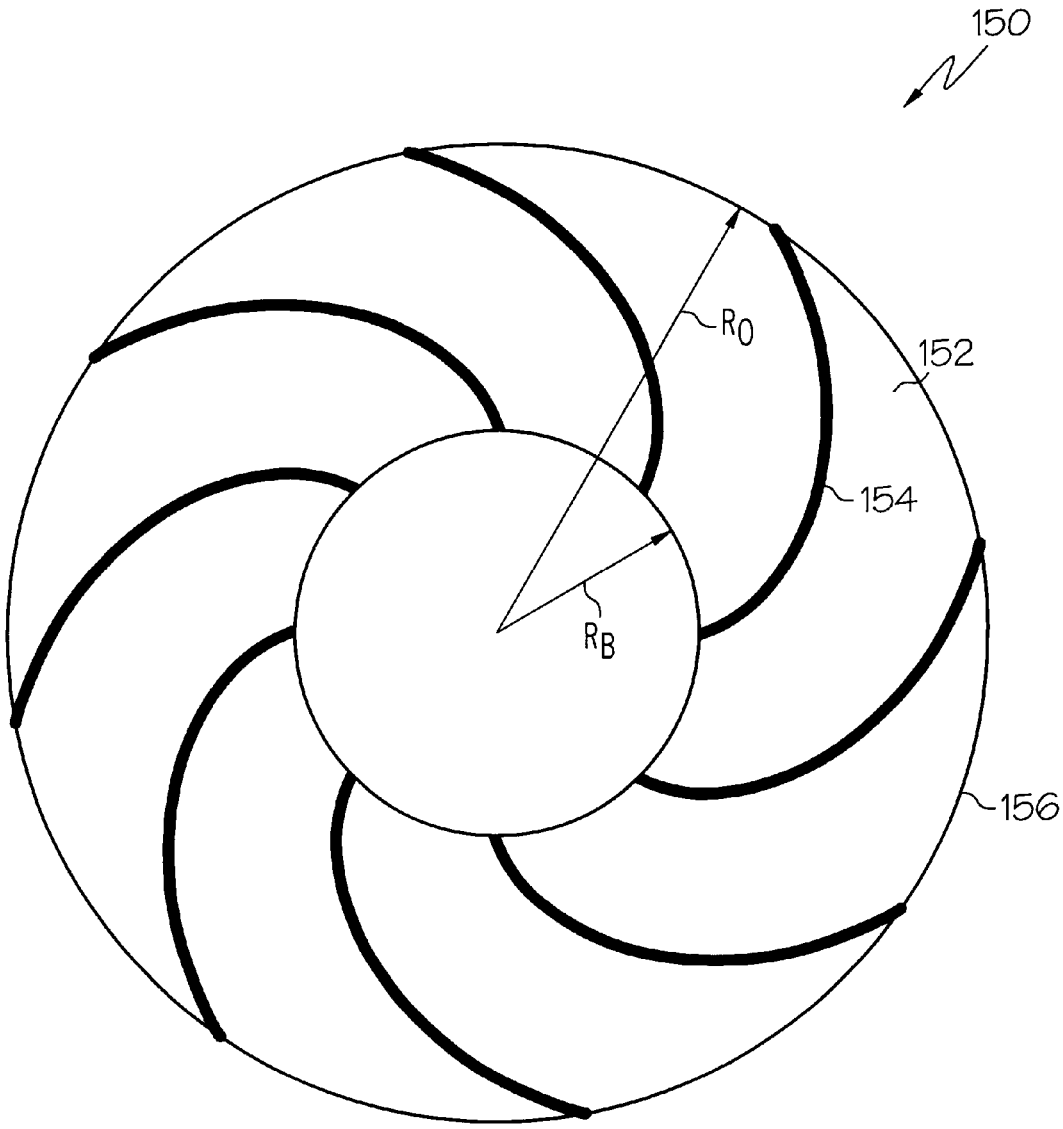
FIG. 6A is a plot of a groove pattern according to the present invention, with a 24 inch pad outer radius $R_O$ and a 10 inch base radius $R_B$.

FIGS. 6A–6D show a variety of example embodiments of groove patterns formed in accordance with the present invention. FIG. 6A is a plot of the curved groove pattern formed according to the present invention, wherein the polishing pad 150 has eight grooves 154 formed in its polishing layer 152. This polishing pad 150 has an outer radius $R_O$=24 inches defining the outer perimeter 156 and a base radius $R_B$=10 inches.

Figure 6B:
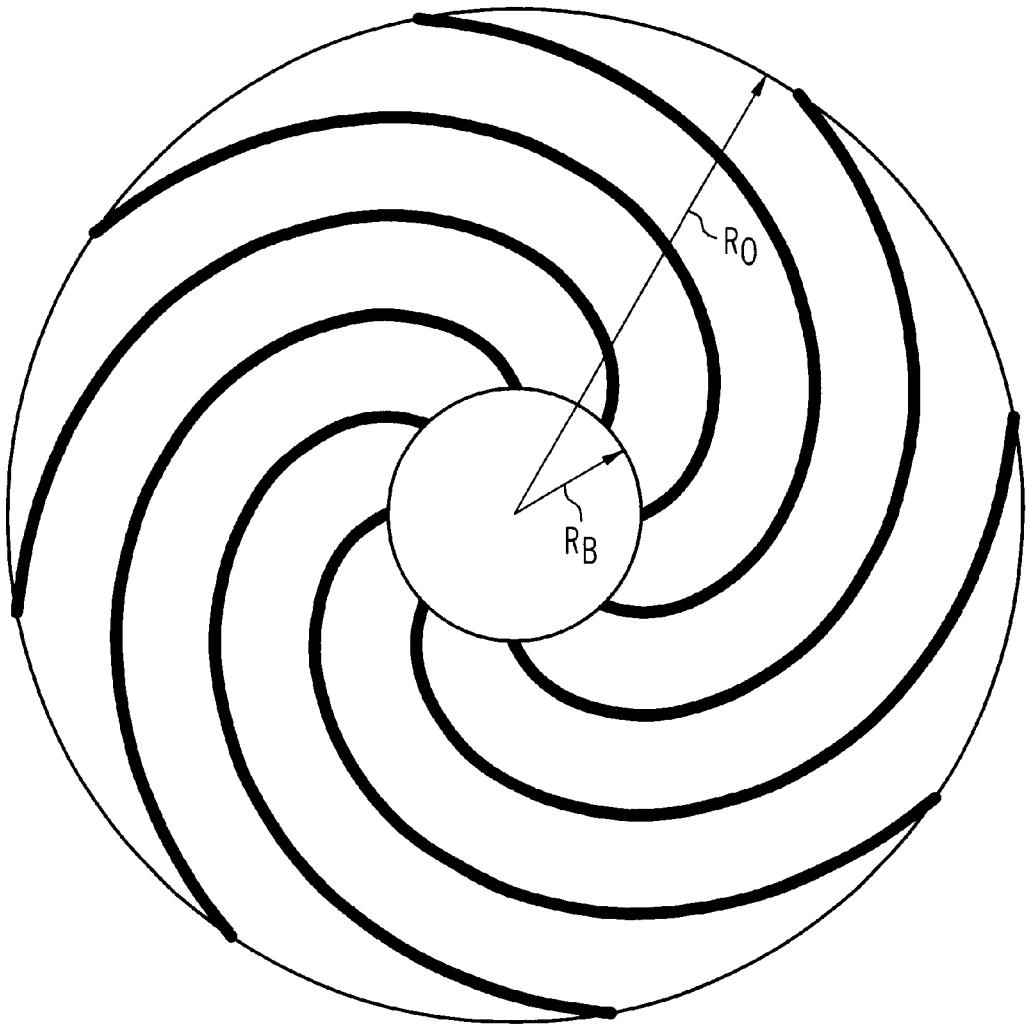
FIG. 6B is a plot of the curved groove pattern according to the present invention, with a 24 inch pad outer radius $R_O$, a 6 inch base radius $R_B$, and 8 curved grooves.

FIG. 6B is the same as FIG. 6A, but with a base radius $R_B$=6 inches.

Figure 6C:
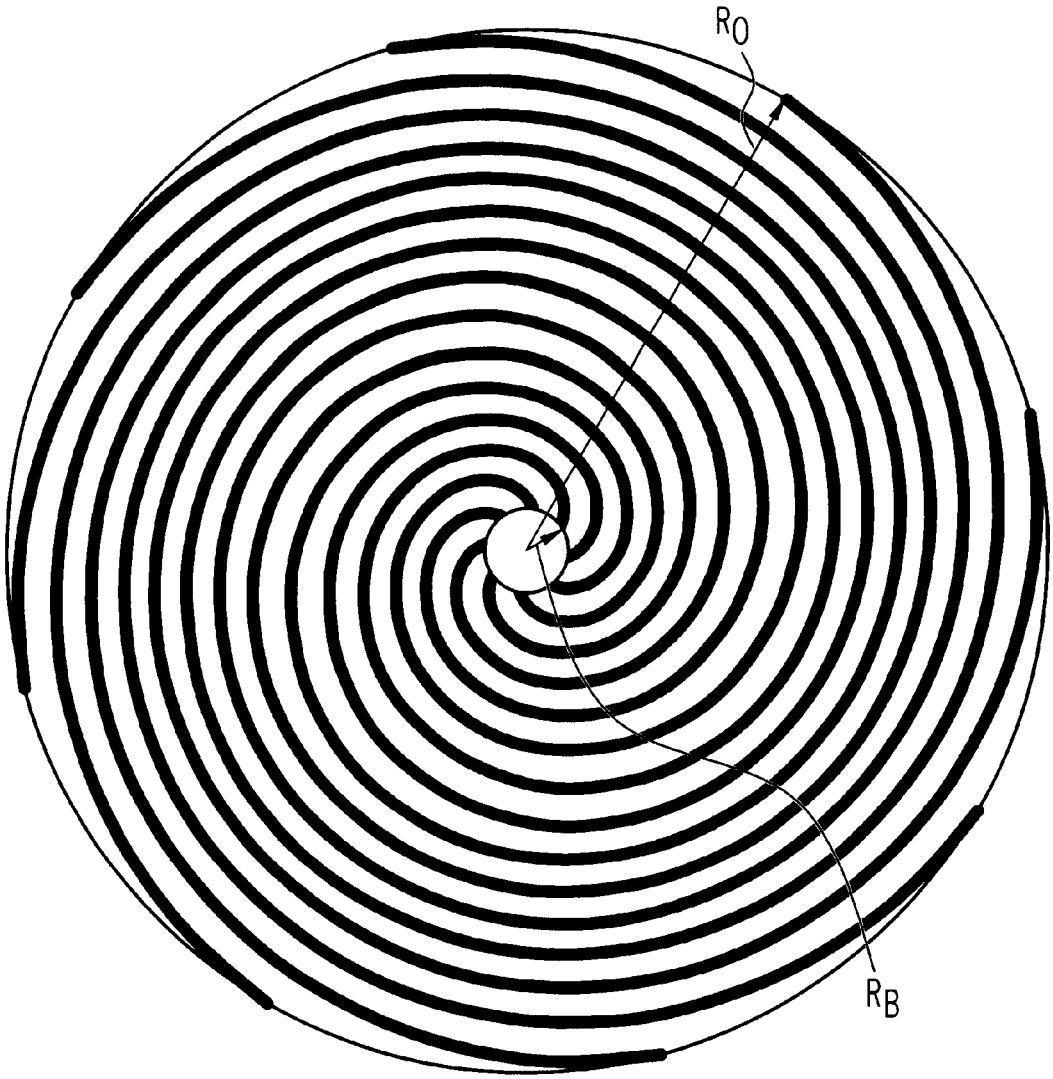
FIG. 6C is a plot of the curved groove pattern according to the present invention similar to FIG. 6B, but with a 2 inch base radius $R_B$.

FIG. 6C is the same as FIG. 6A, but with a base radius $R_B$=2 inches.

Figure 6D:
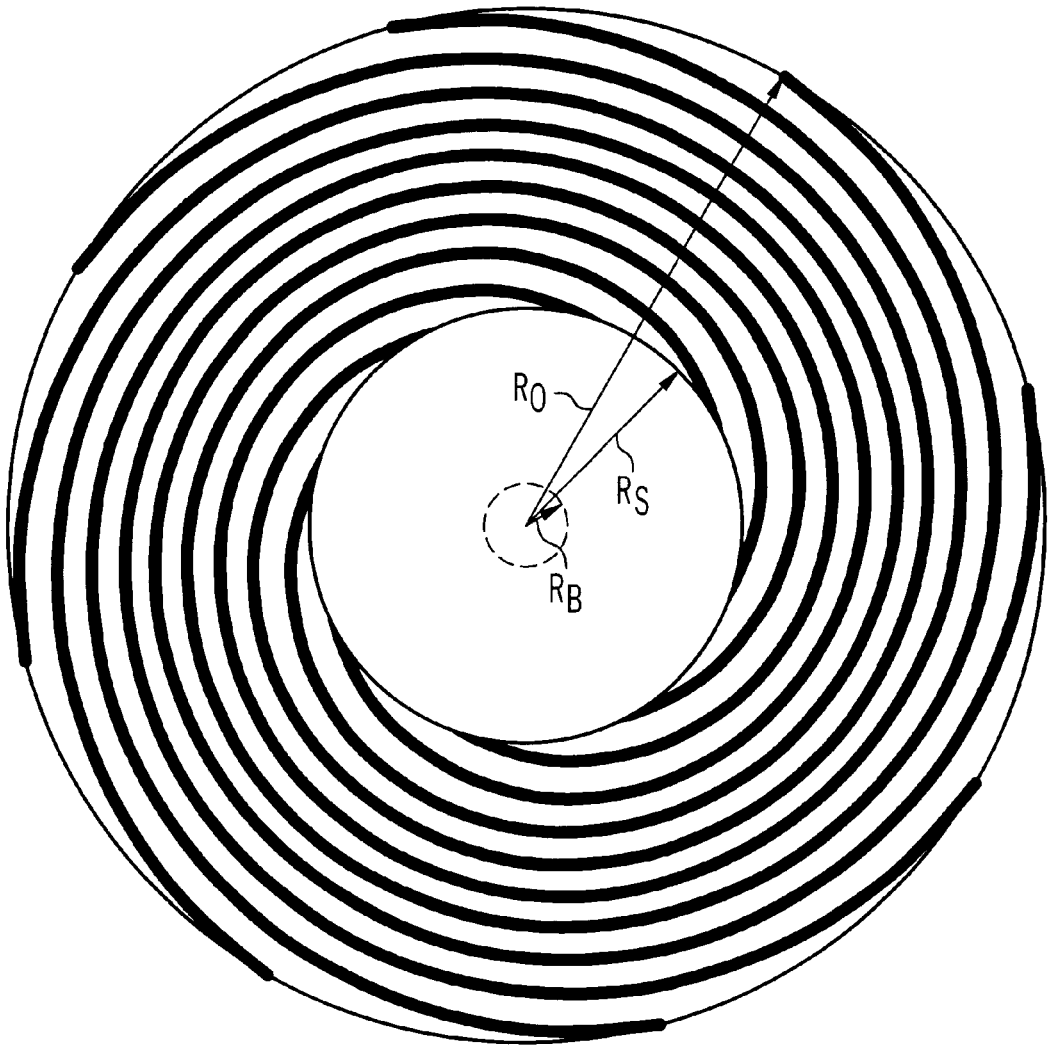
FIG. 6D is a plot of the curved groove pattern according to the present invention similar to FIG. 6C, but with the pattern starting at a starting radius $R_S$=10 inches.

FIG. 6D is the same as FIG. 6C, but with $R_B$=2 inches and the grooves starting at a 10 inch starting radius $R_S$.

Figure 6E:
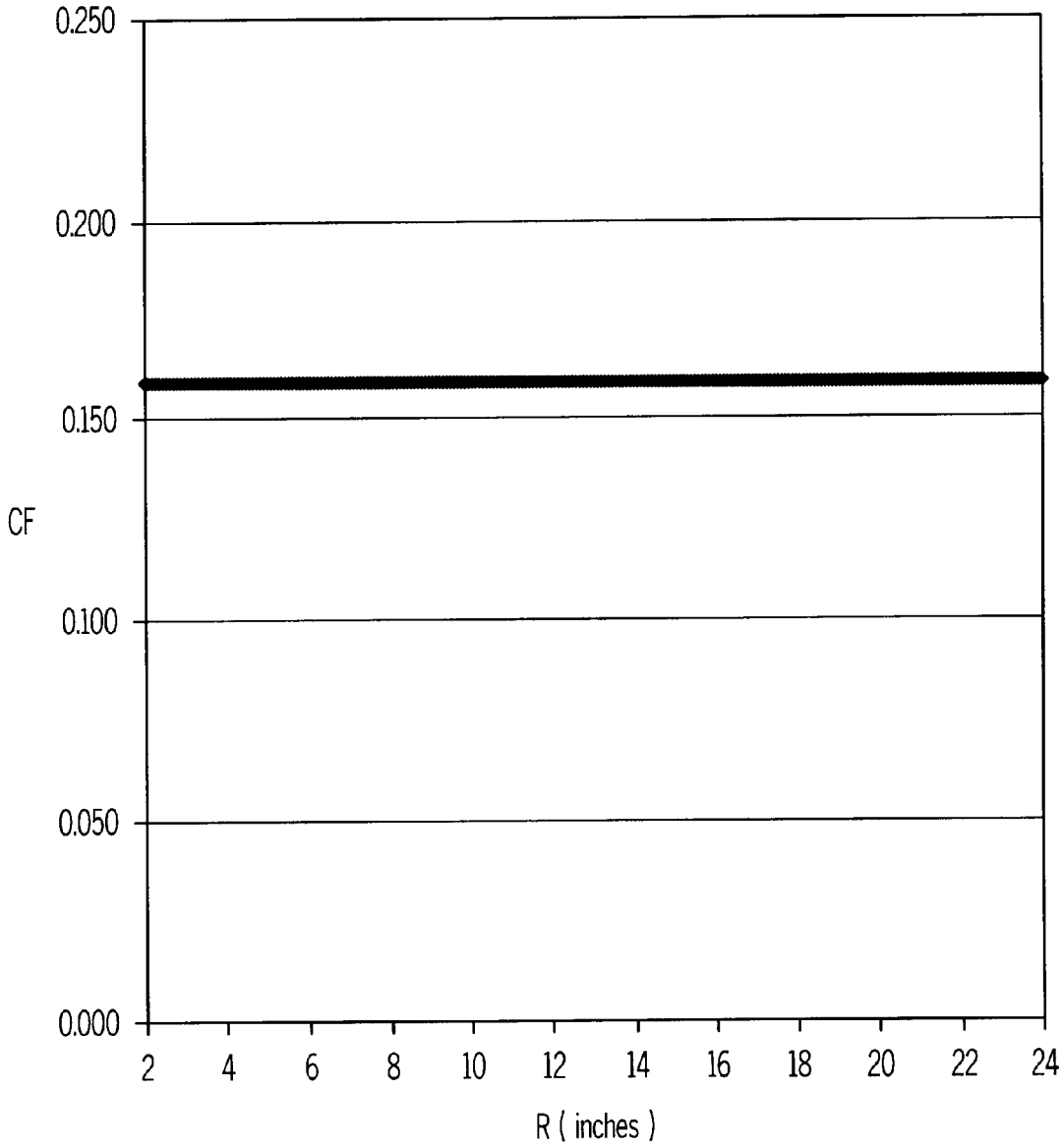
FIG. 6E is a plot of the circumference fraction grooved CF as a function of pad radius R for the curved groove pattern of the present invention, illustrating the invariance of CF as a function of pad radius R.

FIG. 6E is a plot of the circumference fraction grooved CF as a function of pad radius R for the curved groove patterns of FIGS. 6A–6D. As can be seen from FIG. 6E, CF is invariant as function of pad radius R.

CMP System and Method of Operation

Figure 7:
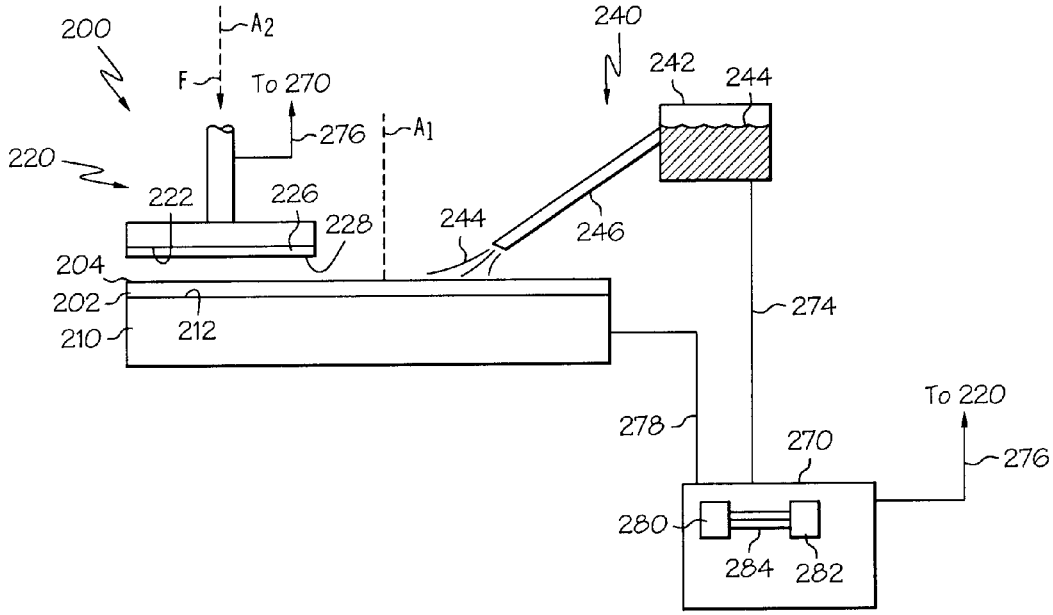
FIG. 7 is a schematic side view of a CMP system employing a grooved polishing pad formed in accordance with the present invention.

FIG. 7 shows a CMP system 200 that employs an embodiment of a polishing pad 202 of the present invention as described in detail above. Polishing pad 202 has a polishing layer 204. System 200 includes a polishing platen 210 rotatable about an axis A1. Platen 210 has an upper surface 212 upon which pad 202 is mounted. A wafer carrier 220 rotatable about an axis A2 is supported above polishing layer 204. Wafer carrier 220 has a lower surface 222 parallel to polishing layer 204. Wafer 226 is mounted to lower surface 222. Wafer 226 has a surface 228 that faces polishing layer 204. Wafer carrier 220 is adapted to provide a downward force F so that wafer surface 228 is pressed against polishing layer 204.

System 200 also includes a slurry supply system 240 with a reservoir 242 (e.g., temperature controlled) that holds a slurry 244.

Slurry supply system 240 includes a conduit 246 connected to the reservoir and in fluid communication with polishing layer 204 for dispensing slurry 244 onto the pad.

System 200 also includes a controller 270 coupled to slurry supply system 240 via a connection 274, to wafer carrier 220 via a connection 276, and to polishing platen 210 via a connection 278. Controller 270 controls these system elements during the polishing operation. In an example embodiment, controller 270 includes a processor (e.g., a CPU) 280, a memory 282 connected to the processor, and support circuitry 284 for supporting the operation of the processor, memory and other elements in the controller.

With continuing reference to FIG. 7, in operation controller 270 activates slurry supply system 240 to dispense slurry 244 onto the rotating polishing layer 204. The slurry spreads out over the polishing pad upper surface, including the portion of the surface beneath wafer 226. Controller 270 also activates wafer carrier 220 to rotate at a select speed (e.g., 0 to 150 revolutions-per-minute or "rpm.") so that the wafer surface moves relative to the polishing surface. Wafer carrier 220 also provides a select downward force F (e.g., 0–15 psi) so that the wafer is pressed against the polishing pad. Controller 270 further controls the rotation speed of the polishing platen, which speed is typically between 0–150 rpm.

Because polishing layer 204 has a groove structure formed using the methods described above to have a constant CF, the planarization efficiency is higher than that for grooves having a non-constant CF. The benefits to planarization efficiency are realized regardless of the direction of rotation of polishing layer 204. Increased planarization efficiency results in planarization with less material being removed from the wafer, faster processing of the wafer, and less chance of damaging the wafer surface.

Because of the more uniform polishing area per unit pad area of polishing pad 202 in contact with the wafer, in an example embodiment the downward force provided by the wafer carrier may be less than that required with conventional polishing pads to achieve material removal at all desired points on the wafer.

What is claimed is:

1. A polishing pad useful for chemical mechanical planarization, the polishing pad having a polishing layer for planarizing substrates, the polishing layer comprising:

a radius that extends from a center of the polishing layer to an outer perimeter of the polishing layer;

one or more continuous grooves formed in the polishing layer and extending inward from the outer perimeter of the polishing layer; and a circumference fraction grooved (CF) in an area extending from the outer perimeter of the polishing layer a majority distance to the center of the polishing layer, CF being that portion of circumference at a given radius lying across the one or more continuous grooves divided by full circumference at the given radius, and wherein CF remains within 25% of its average value as a function of the polishing layer radius in the entire area extending from the outer perimeter of the polishing layer the majority distance to the center of the polishing layer.

2. The polishing pad of claim 1, wherein the CF remains within 10% of its average value as a function of the polishing layer radius in the area extending from the outer perimeter of the polishing layer the majority distance to the center of the polishing layer.

3. The polishing pad of claim 1, wherein the CF remains constant from the outer perimeter of the polishing layer a majority distance to the center of the polishing layer.

4. The polishing pad of claim 1, wherein the one or more continuous grooves extend from a base radius of the polishing layer to the outer perimeter of the polishing layer.

5. The polishing pad of claim 1, wherein the one or more continuous grooves extend from a starting radius to the outer perimeter, the starting radius being between a base radius and the outer perimeter.

6. The polishing pad according to claim 1, wherein the average value of CF is between 10% and 25%.

7. The polishing pad according to claim 1, wherein the one or more grooves are continuous curves.

8. A method of chemical mechanical planarizing a substrate comprising the steps of:

introducing a polishing solution to a wafer, rotating the wafer with respect to a polishing pad, the polishing pad having a polishing layer, and the polishing layer comprising: i) a radius that extends from a center of the polishing layer to an outer perimeter of the polishing layer; ii) one or more continuous grooves formed in the polishing layer and extending inward from the outer perimeter of the polishing layer; and iii) a circumference fraction grooved (CF) in an area extending from the outer perimeter of the polishing layer a majority distance to the center of the polishing layer, CF being that portion of circumference at a given radius lying across the one or more continuous grooves divided by full circumference at the given radius, and wherein CF remains within 25% of its average value as a function of the polishing layer radius in the entire area extending from the outer perimeter of the polishing layer the majority distance to the center of the polishing layer; and planarizing the wafer with the polishing pad and the polishing solution.

9. The method of claim 8, wherein the planarizing occurs only within the area extending front the outer perimeter of the polishing layer the majority distance to the center of the polishing layer.

10. The method of claim 8, wherein the planarizing occurs with the one or more continuous grooves being continuous curves.

* * * * *

UNITED STATES PATENT AND TRADEMARK OFFICE

CERTIFICATE OF CORRECTION

PATENT NO. : 6,783,436 B1
APPLICATION NO. : 10/425689
DATED : August 31, 2004
INVENTOR(S) : Muldowney It is certified that error appears in the above-identified patent and that said Letters Patent is hereby corrected as shown below:

Column 5, line 34, replace

“ $$dS = dR \tan\theta = \sqrt{\left(\frac{R}{R_s}\right)^2 - 1}\ dR$$ ”

with

-- $$dS = dR \tan\theta = \sqrt{\left(\frac{R}{R_B}\right)^2 - 1}\ dR$$ --;

line 39, replace

“ $$\varphi(R) = S(R)/R = \int_{R_S}^{R} \frac{dS}{R} = \int_{R_B}^{R} \sqrt{\left(\frac{R}{R_W}\right)^2 - 1}\ \frac{dR}{R}$$ ”

with

-- $$\varphi(R) = S(R)/R = \int_{R_B}^{R} \frac{dS}{R} = \int_{R_B}^{R} \sqrt{\left(\frac{R}{R_B}\right)^2 - 1}\ \frac{dR}{R}$$ --;

UNITED STATES PATENT AND TRADEMARK OFFICE

CERTIFICATE OF CORRECTION

PATENT NO. : 6,783,436 B1
APPLICATION NO. : 10/425689
DATED : August 31, 2004
INVENTOR(S) : Muldowney It is certified that error appears in the above-identified patent and that said Letters Patent is hereby corrected as shown below:

line 46, replace

" $$\varphi(R) = \sqrt{\left(\frac{R}{R_s}\right)^2 - 1} \div \sin^{-1}\left(\frac{R_s}{R}\right) - \frac{\pi}{2}$$ "

with

-- $$\varphi(R) = \sqrt{\left(\frac{R}{R_B}\right)^2 - 1} + \sin^{-1}\left(\frac{R_B}{R}\right) - \frac{\pi}{2}$$ --.

Signed and Sealed this

First Day of April, 2008

JON W. DUDAS
*Director of the United States Patent and Trademark Office*